US006223674B1

(12) United States Patent
Wyman et al.

(10) Patent No.: US 6,223,674 B1
(45) Date of Patent: May 1, 2001

(54) GENTILE PERFORMANCE WEDGE (GPW) SHOCK MITIGATION PLANNING BOAT HULL

(75) Inventors: David B. Wyman; Richard M. Gollwitzer; Ronald S. Peterson, all of Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 08/999,946

(22) Filed: Aug. 11, 1997

Related U.S. Application Data

(63) Continuation-in-part of application No. 08/701,365, filed on Aug. 21, 1996, now abandoned.

(51) Int. Cl.[7] ..... B63B 1/00
(52) U.S. Cl. ..... 114/271; 114/284
(58) Field of Search ..... 114/271, 279, 114/284–287, 291, 292, 355–357

(56) References Cited

U.S. PATENT DOCUMENTS 1,746,912 * 2/1930 Smith ..... 114/291
2,265,206 * 12/1941 Stampfl ..... 114/287
3,559,222 * 2/1971 Walker ..... 114/287

FOREIGN PATENT DOCUMENTS

2508205 * 9/1976 (DE) ..... 114/287

* cited by examiner

*Primary Examiner*—Ed Swinehart
(74) *Attorney, Agent, or Firm*—Harvey A. Gilbert; Donald G. Peck

(57) ABSTRACT

A planing boat's primary hull has an adjunct hull surface rotatably connected thereto near its forward end. The adjunct hull surface extends along the hull of the planing boat to aft of amidships and is constructed of a rigid material that conforms to the shape of the hull of the planing boat. A position controller is coupled to the adjunct hull surface to selectively position the adjunct hull surface relative to the hull of the planing boat. When the adjunct hull surface is spaced apart from the hull of the planing boat, the position controller also absorbs shock loads experienced by the adjunct hull surface.

8 Claims, 1 Drawing Sheet

GENTILE PERFORMANCE WEDGE (GPW) SHOCK MITIGATION PLANNING BOAT HULL

This is a continuation-in-part of copending application Ser. No. 08/701,365 filed on Aug. 21, 1996, now abandoned.

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to adaptive hulls for a boat operating at planing speeds. More specifically, the present invention relates to a system for reconfiguring the shape of a boat hull during operation to mitigate shock loads in rough water and improve performance during planing in smooth or rough water.

BACKGROUND OF THE INVENTION

The typical planing boat hull for use in rough water makes use of a deep vee shape that tends to cut into the waves instead of violently impacting the water's surface as is the case with a flatter hull bottom. This deep vee hull design reduces some of the shocks, but at high speed in rough seas the shocks can still cause injury to personnel and damage equipment. The typical deep vee hull also requires more propulsion power than a shallower vee hull of equal weight for a given speed.

SUMMARY OF THE INVENTION

Accordingly, it is an object of the present invention to provide a boat hull configuration that will reduce shock loads on the boat and its occupants when operating at planing speeds in rough water.

Another object of the present invention is to provide a boat hull configuration having the ability to plane at greater speed for a given hull weight or be able to carry more weight at the same speed.

Still another object of the present invention is to provide a movable means for controlling planing and shock impact of a boat hull moving through waves in various sea states.

Finally, it is another object of the present invention to provide a boat hull configuration that is user adjustable to reduce shock load to the hull and its cargo when operating at planing speeds in rough water.

Other objects and advantages of the present invention will become more obvious hereinafter in the specification and drawings.

In accordance with the present invention, a planing boat's primary hull has an adjunct hull surface rotatably connected thereto near its stem, i.e., the forward-most end of the hull. The adjunct hull surface extends along the hull of the planing boat to aft of amidships. The adjunct hull surface is constructed of a rigid material that conforms to the shape of the hull of the planing boat. A position controller is coupled to the adjunct hull surface to selectively position the adjunct hull surface relative to the hull of the planing boat. When the adjunct hull surface is spaced apart from the hull of the planing boat, the position controller also absorbs shock loads experienced by the adjunct hull surface. The adjunct hull surface is positioned during operation for optimum load isolation and/or planing performance by the position controller.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1A:
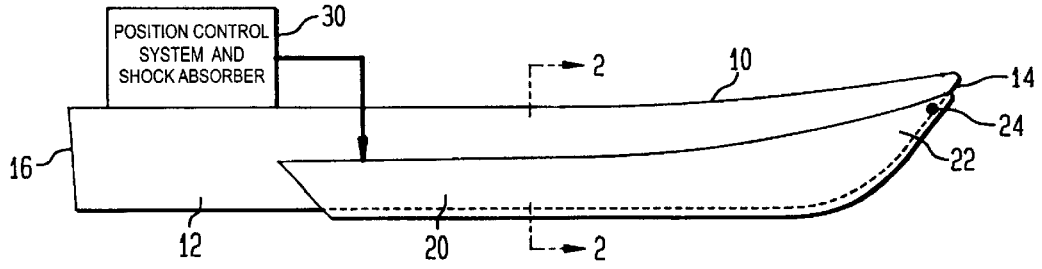
FIG. 1A is a side view of a planing boat hull shown with the shock mitigating system of the present invention in its retracted position.
Figure 1B:
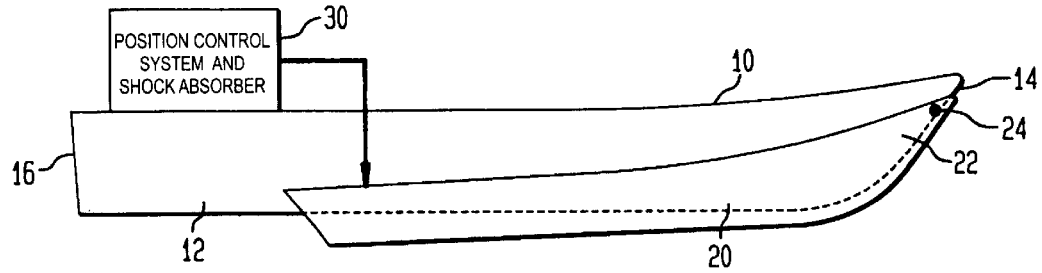
FIG. 1B is a side view of the planing boat hull shown with the shock mitigating system of the present invention in an extended position.
Figure 2:
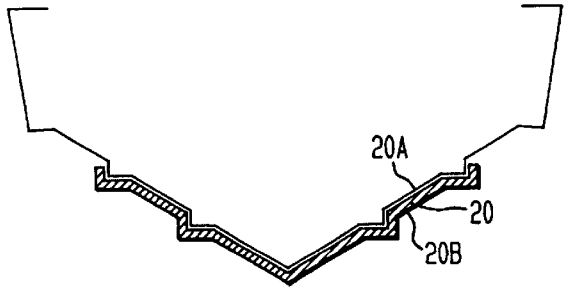
FIG. 2 is a cross-sectional view taken along line 2-2 of FIG. 1A.

Referring now to the drawings, and with simultaneous reference to FIGS. 1A, 1B and 2, several views are shown of a planing boat 10 equipped with the shock mitigating system of the present invention. Planing boat 10 is representative of any high-speed planing boat having a hull 12 with the forwardmost portion of its bow known as the stem indicated at 14 and the stern indicated at 16. While the present invention is based on the shape of hull 12, it is to be understood that the particular choice of hull 12 is not a limitation on the present invention.

Pivotally attached to stem 14 planing boat 10 is a movable secondary or adjunct hull surface 20. More specifically, the forward end 22 of adjunct hull surface 20 is hinged at point 24 to hull 12 to allow rotational movement of surface 20 towards and away from hull 12. The movement and/or positioning of adjunct hull surface 20 will be explained further below. However, at this point in the description, it is sufficient to note that adjunct hull surface 20 can be fully retracted against and nested with hull 12 (FIG. 1A) or selectively positioned in a spaced-apart relationship with hull 12 (FIG. 1B).

Adjunct hull surface 20 is typically made from rigid sheet material such as fiberglass, aluminum, steel or any other rigid material suitable for use in boat hull construction. All along its length, adjunct hull surface 20 is shaped on its top surface 20A and bottom surface 20B to conform to the shape of hull 12 as is apparent in the cross-sectional view shown in FIG. 2. In terms of its length, adjunct hull surface 20 extends to a location on hull 12 that is aft of amidships of planing boat 10. In the present invention, adjunct hull surface 20 must be more than half the length of hull 12, but considerably less than the full length of hull 12. This is because adjunct hull surface 20 must support approximately two-thirds of the hull's weight when planing, but not all of it because some weight must be present at the aft end of hull 12 to provide longitudinal stability in the vertical direction. Typically, the length of adjunct hull surface 20 is approximately two-thirds the length of planing boat 10. The width of adjunct hull surface 20 is also not limited to a specific measurement. However, for many high-speed planing boats, the width of adjunct hull surface 20 is approximately two-thirds the chine width of hull 12. Note that the width of surface 20 could be the full width of hull 12 for a heavily loaded hull while for a lightly loaded hull, the width of surface 20 may only need to be one-half or less the width of hull 12.

Figure 3:
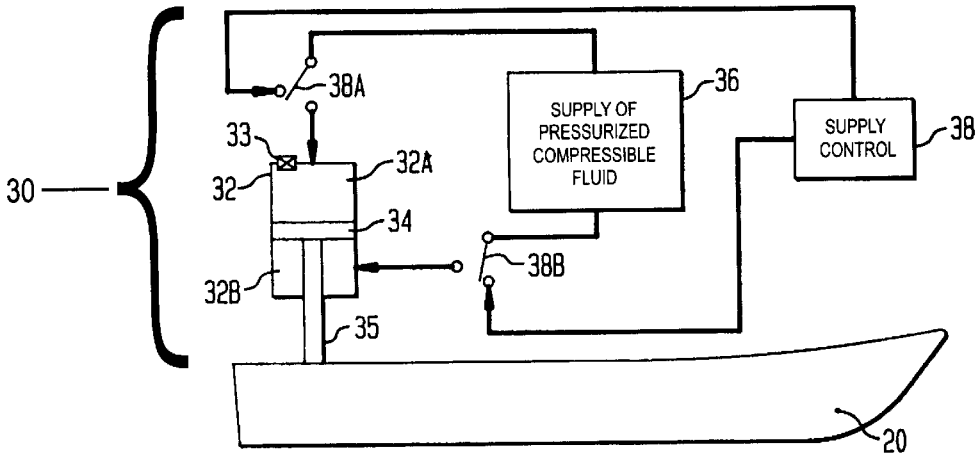
FIG. 3 is a schematic view of the position controller used to control both position and reactive movement of the adjunct hull surface in the present invention.

To control both the position of adjunct hull surface 20 with respect to hull 12, and control the shock mitigation afforded by the present invention, a position control and shock absorber system 30 is coupled to adjunct hull surface 20. A preferred embodiment of position control and shock absorber system 30 is shown schematically in FIG. 3. System 30 includes a cylinder 32 housing a piston 34 that is coupled (e.g., via piston rod 35) to adjunct hull surface 20. Piston 34 defines a first chamber 32A and a second chamber 32B in cylinder 32. A supply 36 of pressurized compressible fluid (e.g., hydraulic fluid, air, etc.) is selectively introduced into chambers 32A and 32B as controlled by a supply control 38 through respective valves 38A and 38B. Supply control 38 is representative of user controls or an adaptive control system. To positively maintain adjunct hull surface 20 in its retracted or nested position (for low speeds or trailer handling) with respect to hull 12 (FIG. 1A), the pressure in chamber 32A is kept less than the combination of the pressure in chamber 32B and the water pressure impressed upon bottom surface 20B of surface 20. To position adjunct hull surface 20 away from hull 12 (FIG. 1B), supply control 38 causes supply 38 to increase the pressure in chamber 32A. More specifically, the pressure increase must overcome the pressure in chamber 32B and any upward forces impinging on bottom surface 20B of surface 20. Once pressurized in this fashion, cylinder 32, piston 34 and compressible fluids in chambers 32A and 32B cooperate to work as a spring.

In operation, as hull 12 is propelled by a motor (not shown) to the point of planing, a user operates supply control 38 to permit the introduction of pressurized compressible fluid from supply 36 into chamber 32A of cylinder 32. As chamber 32A is pressurized to overcome both the pressure in chamber 32B and the water pressure on adjunct hull surface 20, piston 34 moves downward to rotate surface 20 (about hinge point 24) downward and away from hull 12 as shown in FIG. 1B. In general, adjunct hull surface 20 is lowered for planing and raised to nest with hull 12 for slow speed operation or when hull 12 is placed on a trailer. Thus, the force provided by position control and shock absorber system 30 can be varied to adjust the position of surface 20 relative to hull 12 and to adjust reactive movement of surface 20 in response to various impact loads and sea states.

At planing speeds, chamber 32A is pressurized such that piston 34 is moved downward to extend adjunct hull surface 20 to approximately half of its maximum range thereby forming a step in the hull shape. When the forward part of hull 12 becomes airborne, adjunct hull surface 20 extends to its maximum position due to the pressure in chamber 32A and the elimination of water pressure on bottom surface 20B. Then, when adjunct hull surface 20 descends and again makes contact with the water, surface 20 moves upward slowly as the pressure in chamber 32A slows the descent of hull 12 towards the water. A bleed valve 33 can be provided in chamber 32A to let excess pressure escape from chamber 32A during water impact. In addition, whenever adjunct hull surface 20 is spaced from hull 12 while in the water, a stepped hull configuration is produced by the present invention. In this way, the main planing surface of planing boat 10 is forward and raised.

The advantages of the present invention are numerous. Adjunct hull surface 20 is more than a simple planing surface. First, it should be understood that it is a three-dimensional rigid body. Thus, when it is forcibly immersed in the slip-stream of water moving past hull 12, it is producing a hull response beyond simple planing. In particular, the action of the immersed surface 20 combined with the positioning and shock damping effects provided by position control and shock absorber system 30 produces a hull response satisfying all the objectives recited herein, including improving hull efficiency and performance. Adjunct hull surface 20 and position control and shock absorber system 30 work together to increase the time for hull 12 to decelerate when impacting a wave. As surface 20 moves upwards from its extended or immersed position against the forces supplied by the pressurized compressible fluid in chamber 32A, some of the impact energy is absorbed before hull 12 makes contact with the water. Tests have shown that time for hull impact is increased to approximately 100 milliseconds from approximately 50 milliseconds for a typical deep vee high-speed boat. In addition to mitigating hull impact shock, the movable surface 20 provides a step in a planing surface that, at higher speeds, i.e., above 20 knots, increases performance efficiency. The present invention will work with any hull shape propelled at planing speeds, i.e., when the hull is supported by dynamic lift rather than buoyancy.

Although the present invention has been described relative to a particular embodiment thereof, it is not so limited. For example, additional planing surfaces (not shown) can be mounted on the port and starboard sides of stern 16 equidistant from the longitudinal centerline of hull 12. Each such stern-mounted planing surface can be hinge connected to hull 12 aft of adjunct hull surface 20. Control of each stern planing surface can be accomplished by a similar system to position control and shock absorber system 30 described above. It is therefore to be understood that, within the scope of the appended claims, the invention may be practiced other than as specifically described.

What is claimed as new and desired to be secured by Letters Patent of the United States is:

1. A shock mitigating system for a planing boat having a hull extending from a forward end to an aft end, the hull further having a centerline running from the forward end to the aft end, said shock mitigating system comprising:

a one-piece adjunct hull surface pivotally coupled at one end thereof to the forward end of the hull of said planing boat, said adjunct hull surface extending along the hull of said planing boat on either side of the centerline to aft of amidships of said planing boat, said adjunct hull surface being constructed of a rigid material that has upper and lower surfaces conforming to the shape of the hull of said planing boat on either side of the centerline; and a position controller coupled to said adjunct hull surface for selectively positioning said adjunct hull surface between a first position and a second position wherein, in said first position, said adjunct hull surface rests against the hull and wherein, in said second position, said adjunct hull surface pivots at said one end and is spaced apart from the hull, said position controller further absorbing shock loads experienced by said adjunct hull surface when said adjunct hull surface is spaced apart from the hull of said planing boat.

2. A shock mitigating system as in claim 1 wherein a length of said adjunct hull surface is approximately two-thirds the length of said planing boat.

3. A shock mitigating system as in claim 1 wherein said position controller comprises:

a cylinder having a piston, said piston being coupled to said aft portion of said adjunct hull surface; and a pressure system coupled to said cylinder for selectively supplying a compressible fluid under pressure to said cylinder for controlling the position of said piston in said cylinder.

4. A shock mitigating system as in claim 1 wherein said compressible fluid is air.

5. A shock mitigating system for a planing boat having a hull extending from a forward end to an aft end, the hull further having a centerline running from the forward end to the aft end, said shock mitigating system comprising:

a one-piece adjunct hull surface pivotally coupled at one end thereof to the forward end of the hull of said planing boat, said adjunct hull surface extending along the hull of said planing boat on either side of the centerline to aft of amidships of said planing boat, said adjunct hull surface being constructed of a rigid material that has upper and lower surfaces conforming to the shape of the hull of said planing boat on either side of the centerline;

a spring coupled between said adjunct hull surface and said planing boat; and a biasing system coupled to said spring for biasing said spring such that said adjunct hull surface can be selectively positioned anywhere between a first position and a second position wherein, in said first position, said adjunct hull surface rests against the hull and wherein, in said second position, said adjunct hull surface pivots at said one end and is spaced apart from the hull, wherein said spring absorbs shock loads experienced by said adjunct hull surface when said adjunct hull surface is spaced apart from the hull of said planing boat.

6. A shock mitigating system as in claim 5 wherein a length of said adjunct hull surface is approximately two-thirds the length of said planing boat.

7. A shock mitigating system as in claim 5 wherein said spring is an air spring.

8. A shock mitigating system as in claim 5 wherein said spring is a hydraulic spring.

* * * * *